US012091736B2

(12) United States Patent
Huang et al.

(10) Patent No.: US 12,091,736 B2
(45) Date of Patent: Sep. 17, 2024

(54) SPINNING PROCESS OF MAGNESIUM ALLOY WHEEL HUB

(71) Applicant: CITIC Dicastal Co., Ltd., Qinhuangdao (CN)

(72) Inventors: Lixin Huang, Qinhuangdao (CN); Zuo Xu, Qinhuangdao (CN); Meng Li, Qinhuangdao (CN); Shiwen Xu, Qinhuangdao (CN); Liguang Xie, Qinhuangdao (CN); Lijun Zhang, Qinhuangdao (CN)

(73) Assignee: CITIC Dicastal Co., Ltd., Qinhuangdao (CN)

( * ) Notice: Subject to any disclaimer, the term of this patent is extended or adjusted under 35 U.S.C. 154(b) by 183 days.

(21) Appl. No.: 17/576,276

(22) Filed: Jan. 14, 2022

(65) Prior Publication Data

US 2023/0080640 A1 Mar. 16, 2023

(30) Foreign Application Priority Data

Sep. 3, 2021 (CN) ..... 202111031593.4

(51) Int. Cl.
*C22F 1/06* (2006.01)
*B21J 1/06* (2006.01)

(52) U.S. Cl.
CPC .. *C22F 1/06* (2013.01); *B21J 1/06* (2013.01)

(58) Field of Classification Search
CPC ..... C22F 1/06; B21J 1/06; B21J 5/002; B21J 1/003; B21J 5/02; B21J 9/02; B21K 1/34;
(Continued)

(56) References Cited

U.S. PATENT DOCUMENTS 5,902,424 A * 5/1999 Fujita ..... C22F 1/06 148/406
6,143,097 A * 11/2000 Fujita ..... C22C 23/02 148/420
7,523,635 B2 * 4/2009 Ono ..... B60B 3/06 72/356

FOREIGN PATENT DOCUMENTS

CN 107363474 A * 11/2017
CN 108311577 A * 7/2018 ..... B21D 22/16
WO WO-2011096178 A1 * 8/2011 ..... B21J 1/025

OTHER PUBLICATIONS

CN-107363474-A, Chen, machine translation. (Year: 2017).*
CN-108311577-A, Chen. machine translation (Year: 2018).*
WO-2011096178-A1, Ono. machine translation (Year: 2011).*

* cited by examiner

*Primary Examiner* — John A Hevey
(74) *Attorney, Agent, or Firm* — IPro, PLLC

(57) ABSTRACT

The disclosure discloses a spinning process of a magnesium alloy wheel hub, which comprises the following steps: step 1, heating a magnesium alloy bar at 350-430° C. and keeping the temperature for 20 minutes; step 2, initially forging and forming on the bar under a forging press, wherein the forging down-pressing speed is 6-15 mm/s; step 3, finally forging and forming on the bar under a forging press, wherein the forging down-pressing speed is 5-8 mm/s; step 4, stress relief annealing on the final forged magnesium alloy blank; step 5, solid dissolving on the annealed magnesium alloy blank; step 6, taking out the solid-dissolved blank and directly spinning by a spinning machine; step 7, heating treatment and aging treatment. The magnesium alloy wheel hub with excellent performance is obtained by the process, and the spinning process and processing efficiency are greatly improved.

8 Claims, 4 Drawing Sheets

(58) Field of Classification Search
CPC ... B21K 1/40; C21D 1/30; C21D 9/34; C21D 1/26; C21D 8/0273; B21D 22/14; C22C 23/00; C22C 23/04; C22C 23/02
See application file for complete search history.

SPINNING PROCESS OF MAGNESIUM ALLOY WHEEL HUB

TECHNICAL FIELD

The disclosure relates to the technical field of wheels, in particular to a spinning process of a magnesium alloy wheel hub.

BACKGROUND

Magnesium alloy is an alloy based on magnesium and other addition elements, with low density, high specific strength, large specific elastic modulus, good heat dissipation and shock elimination, the ability to bear impact load greater than that of aluminum alloy, and the corrosion resistance of organic matter and alkali, and is the lightest metal among practical metals with the specific gravity of magnesium being about ⅔ of that of aluminum and ¼ of that of iron, so it is widely used in automobile, aviation and aerospace fields, especially in automobile field. For example, parts made of magnesium alloy can make automobiles lightweight. Nowadays, for increasingly high demand of lightweight automobiles, the application of aluminum alloy has encountered a bottleneck in the weight reduction effect of automobiles, so the application of magnesium alloy in automobiles is imperative. In recent years, the automobile industry has developed rapidly and changed greatly. Many countries all over the world have introduced the deadline of banning the sale of fuel vehicles. The large-scale application of electric vehicles has brought opportunities for the development of magnesium alloy auto parts.

Magnesium alloy wheel hub has won the favor of more and more users because of its beautiful appearance, safety and comfort. Because of its light weight and high manufacturing precision, magnesium alloy wheel hub has small deformation and small inertia resistance when rotating at high speed. Magnesium alloy wheel hub has the metal characteristics of absorbing vibration and rebound force. After machining by NC machine tools, it has high dimensional accuracy, high roundness, small yaw runout and good balance, which makes the automobile run smoothly and comfortably.

At present, the forging production method of magnesium alloy wheel hub usually adopts forging and extrusion process, the spoke part is usually obtained by forging process, and the wheel rim part is usually obtained by extrusion process.

It is well known that the properties of forging materials are closely related to forging process and sequence. In the spinning process of magnesium alloy, the selection of spinning process and sequence will have an important impact on the performance of magnesium alloy wheel hub. Because of the face-centered cubic structure of magnesium alloy materials, magnesium alloy materials show poor spinning properties. Even if the corresponding products can be forged by traditional forging and extrusion process, they often show poor material properties.

SUMMARY

In view of this, the disclosure aims to provide a spinning process of magnesium alloy wheel hub, which improve the spinning property of magnesium alloy material, and obtain magnesium alloy wheel hub with excellent mechanical properties.

In order to achieve the above object, the technical solution of the present disclosure is realized as follows:

The disclosure relates to a spinning process of a magnesium alloy wheel hub, which comprises the following steps: step 1, heating a magnesium alloy bar to 350-430° C. and keeping the temperature for 20 minutes; step 2, initially forging and forming on the bar under a forging press, wherein the forging down-pressing speed is 6-15 mm/s; step 3, finally forging and forming on the bar under a forging press, wherein the forging down-pressing speed is 5-8 mm/s; step 4, stress relief annealing on the final forged magnesium alloy blank; step 5, solid dissolving on the annealed magnesium alloy blank; step 6, taking out the solid-dissolved blank and directly spinning by a spinning machine; step 7, heating treatment and aging treatment.

In some embodiments, the forging press comprises a 6000-ton forging press.

In some embodiments, the stress relief annealing temperature in step 4 is 300-350° C. and the holding time is 6-8 h.

In some embodiments, the solid solution temperature in step 5 is 390-420° C. and the time is 16 h-24 h;

In some embodiments, the aging treatment temperature in step 7 is 140-170° C. and the aging treatment time is 16-24 h.

In some embodiments, the spinning in step 6 is carried out in three times, with a spinning thinning amount of 25-36%, 14-22%, 6-12%, respectively, and a total thinning amount of 45-70%.

In some embodiments, the spinning feed speed is 120-190 mm/min and the spindle speed is 280-350 r/min.

In some embodiments, the magnesium alloy includes an AZ80 magnesium-aluminum-zinc alloy.

In some embodiments, the magnesium alloy includes a ZK60 magnesium-zinc-zirconium alloy.

In some embodiments, magnesium alloy wheels hub are manufactured by machining after aging treatment.

The manufacturing method of the magnesium alloy wheel hub of the disclosure has the following advantages:

In the disclosure, the magnesium alloy bar is heated to a preset temperature, so that the magnesium alloy bar is easier to deform and is not easy to generate forging cracks. The final forged blank is treated with low temperature insulation first, then heated up and solid dissolved for more than 16 h, and then spun directly at the solid solution temperature of 390-420° C. Spinning is carried out in three times, the thinning (machining) amount is 25-36%, 14-22%, 6-12% respectively, the total thinning amount reaches 45-70%. The feed speed needs to be controlled at 120-190 mm/min, and the spindle speed is controlled at 280-350 r/min, so that the deformation process of magnesium alloy is more continuous, the spinning process is easier, and the magnesium alloy wheel hub with excellent performance is obtained, which greatly improves the spinning process and machining efficiency.

The magnesium alloy wheel hub obtained by the above method still has excellent mechanical properties, which meets the requirements of American wheel SAE J175 and SAE J328-2005, namely, 13-degree impact strength, radial fatigue and bending fatigue performance, and can also meet the requirements of national standards GB/T 5334-2005 and GB/T 15704-1995 for wheel strength and fatigue and industry standard QC/T 991-2015 for passenger car light alloy wheel 90-degree impact test method.

BRIEF DESCRIPTION OF THE DRAWINGS

The accompanying drawings, which form a part of the disclosure, serve to provide a further understanding of the disclosure, and the illustrative embodiments of the disclosure and the description thereof serve to explain the disclosure and are not unduly limiting. In the drawings.

DETAILED DESCRIPTION

Figure 1:
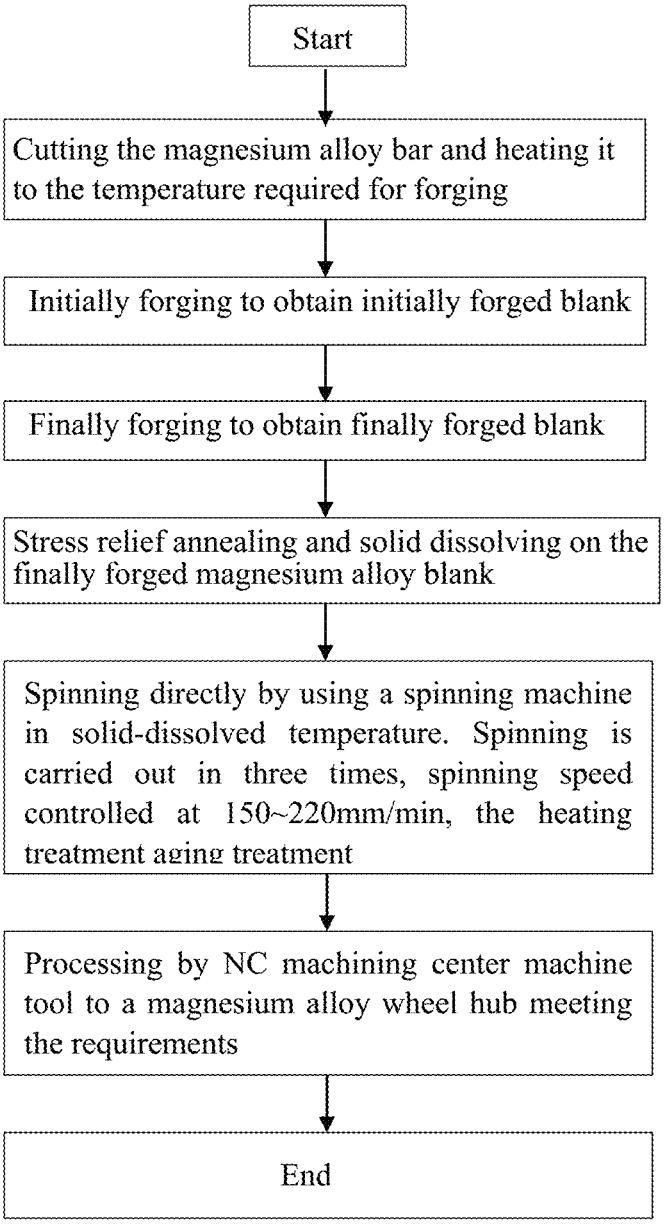
FIG. 1 is a flow diagram of a spinning process of a magnesium alloy wheel hub of the present disclosure.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

A clear and complete description of the technical solution of the present disclosure will be given below with reference to the accompanying drawings and in conjunction with embodiments, which will be apparent that the described embodiments are only part of, and not all of, the embodiments of the present disclosure. Based on the embodiments in the present disclosure, all other embodiments obtained by those of ordinary skill in the art without making creative efforts are within the scope of protection of the present disclosure.

The spinning process of a magnesium alloy wheel hub according to an embodiment of the present disclosure is described below with reference to FIGS. 1 to 7 and in conjunction with embodiments.

A spinning process for a magnesium alloy wheel hub, comprising the following steps:

Step 1. The most suitable and economical bar length is selected by calculating the material length and material ratio of each magnesium alloy wheel hub in advance and the magnesium alloy bar is cut to meet the length required by the wheel hub manufacturing; in a heating furnace, the magnesium alloy bar is heated to 350-420° C. and kept the temperature for 20 minutes.

Step 2. The bar is initial forged and formed under a 6000-ton forging press, which is concave and cake-shaped, and the forging down-pressing speed is 6-15 mm/s.

Step 3. The bar is final forged and formed under a 6000-ton forging press with a forging down-pressing speed of 5-8 mm/s.

Step 4. The final forged magnesium alloy blank is subjected to stress relief annealing at 300-350° C. and kept the temperature for 6-8 h.

Step 5. The annealed magnesium alloy blank is solid dissolved at a temperature of 390-420° C. and the solid solution time of 16-24 h.

Step 6. The solid-dissolved blank is taken out and is spun directly with a spinning machine. The spinning is carried out in three times, with thinning (processing) amounts of 25-36%, 14-22% and 6-12% respectively, and the total thinning amount reaching 45-70%. It is necessary to control the feed speed at 120-190 mm/min and the spindle speed at 280-350 r/min.

Step 7. Heating treatment and aging treatment is carried out, and the aging temperature is 140-170° C. and aging time is 16-24 h.

Step 8. According to the drawing and design requirements of magnesium alloy wheel hub, the magnesium alloy wheel hub meeting the requirements is processed by NC machining center machine tool.

The disclosure selects blank made of AZ80 magnesium-aluminum-zinc alloy and ZK60 magnesium-zinc-zirconium alloy.

The material properties of the processed magnesium alloy wheel hub are tested, and the material properties of spinning materials, including tensile strength, yield strength, elongation and hardness, are tested by tensile testing machine and hardness tester.

Example 1

As shown in FIG. 1, the embodiment of the disclosure provides a spinning process for a magnesium alloy wheel hub, comprising Step 1. The magnesium alloy bar is cut and heated to the temperature required for forging deformation.

In the cutting process of magnesium alloy bar, the most suitable and economical bar length is selected by calculating the material length and material ratio of each magnesium alloy wheel hub in advance, and the bar is cut by a metal cutting machine; in the heating process of magnesium alloy bar to the temperature required for forging deformation, the magnesium alloy bar is heated to a certain temperature in a heating furnace and is kept the temperature for a period of time, wherein, the heating furnace can be an electromagnetic heating furnace and the like; the preset temperature is greater than or equal to 360° C., but it is not allowed to exceed 420° C.; 400° C. is the temperature at which magnesium alloy deformation is most easy and fracture is not easy, which ensures that there will be no crack in the subsequent forging process.

Figure 2:
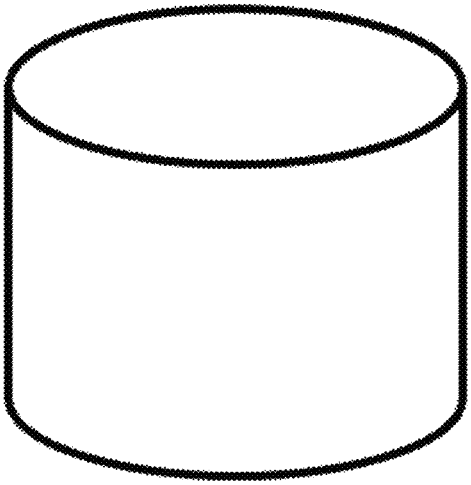
FIG. 2 is a schematic diagram of bar of a magnesium alloy wheel hub in the spinning process of the present disclosure.

Step 2. The magnesium alloy bar is initial forged and formed to obtain initial forged blank. The blank shown in FIG. 2 is initial forged and formed, and the forging down-pressing speed is control at 6-15 mm/s. The purpose of initial forging is to position, which ensure that the bar does not crack during forging.

Figure 3:
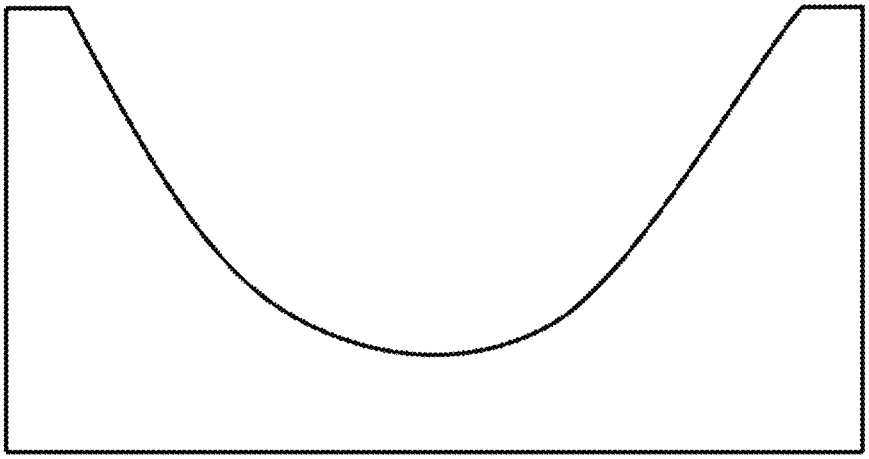
FIG. 3 is a diagram of final forged blank of a magnesium alloy wheel hub in the spinning process of the present disclosure.

Step 3. The bar is final forged and formed to obtain hub blank with spoke basic structure, as shown in FIG. 3.

Step 4. The final forged magnesium alloy blank is subjected to stress relief annealing at a holding temperature of 300-350° C. and a holding time of 6-8 h. The purpose of stress relief annealing is to remove internal stress, release deformation energy storage or weaken deformation energy storage, and prevent abnormal grain growth during subsequent heating.

Step 5. The final forged magnesium alloy blank is solid dissolved and kept the temperature at 390-420° C., and the solid solution time is greater than or equal to 16 h. The purpose of solid solution is to solid solve the precipitated phases in AZ80 alloy and ZK60 alloy to the matrix, make the alloy elements uniformly distributed, reduce the composition segregation at the grain boundary, and make the grains more prone to recrystallization.

Step 6. The solid-dissolved blank is taken out and spun directly by using a spinning machine. Spinning is carried out in three times. The thinning (processing) amounts are 25-36%, 14-22%, 6-12% respectively and the total thinning amount reaches 45-70%. The feed speed needs to be controlled at 120-190 mm/min and the spindle speed is controlled at 280-350 r/min. The purpose of three-times spinning is that the selected AZ80 magnesium alloy and ZK60 magnesium alloy have poor shaping deformation, and the one-time processing capacity is too large, which will cause tension crack. The purpose of controlling spinning speed is to prevent the speed from being too slow, and the temperature drops too fast during spinning, which will lead to narrow processing interval, while the spinning speed is too fast, which will cause transverse tension crack. The wheel rim structure after spinning is shown in FIG. 7.

Step 7. Heating treatment is carried out. Aging treatment is carried out, with aging temperature of 140-170° C. and aging time of 16-24 h.

Figure 4:
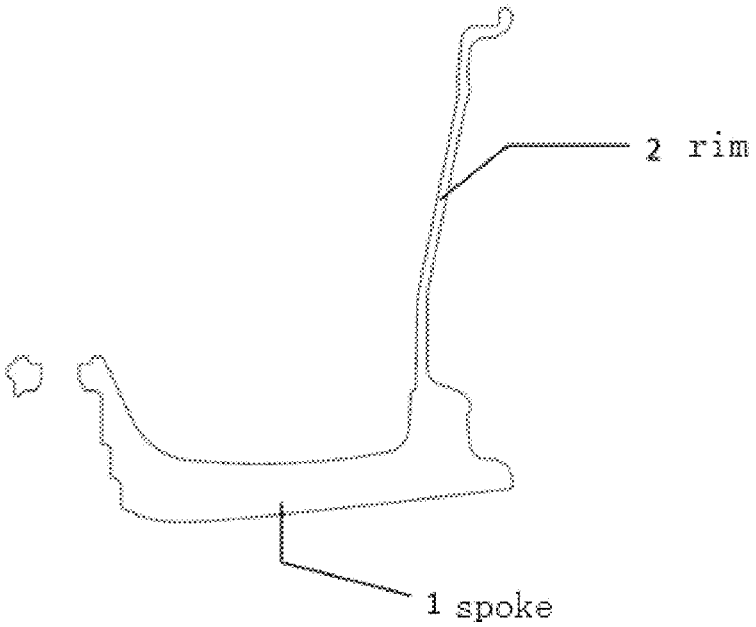
FIG. 4 is a cross-sectional view of hub of the manufacturing method of a magnesium alloy wheel hub of the disclosure.

Step 8. According to the drawing and design requirements of magnesium alloy wheel hub, the magnesium alloy wheel hub meeting the requirements is processed by NC machining center machine tool, as shown in FIG. 4.

Figure 5:
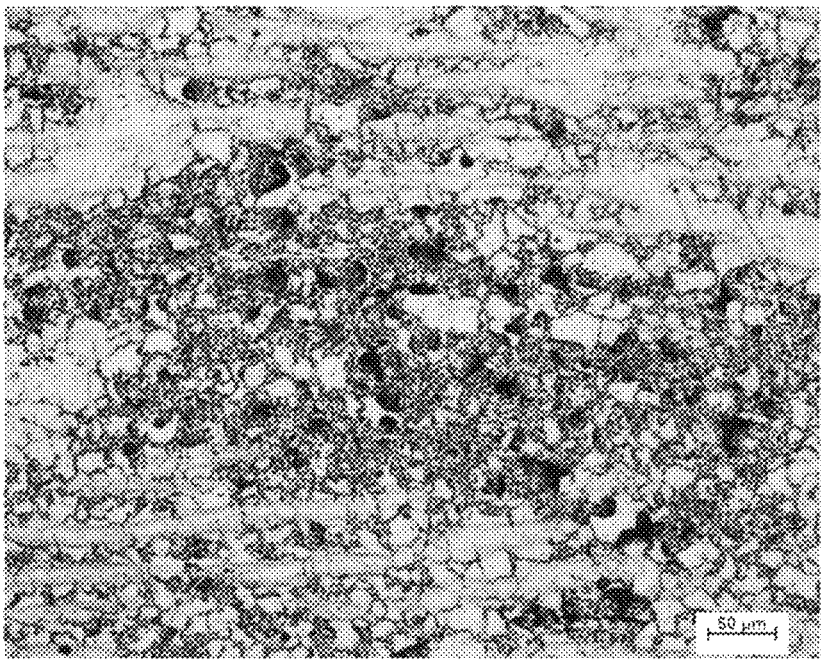
FIG. 5 is a 200-fold metallographic structure of the wheel rim part of a magnesium alloy wheel hub in a new spinning process of the present disclosure.
Figure 7:
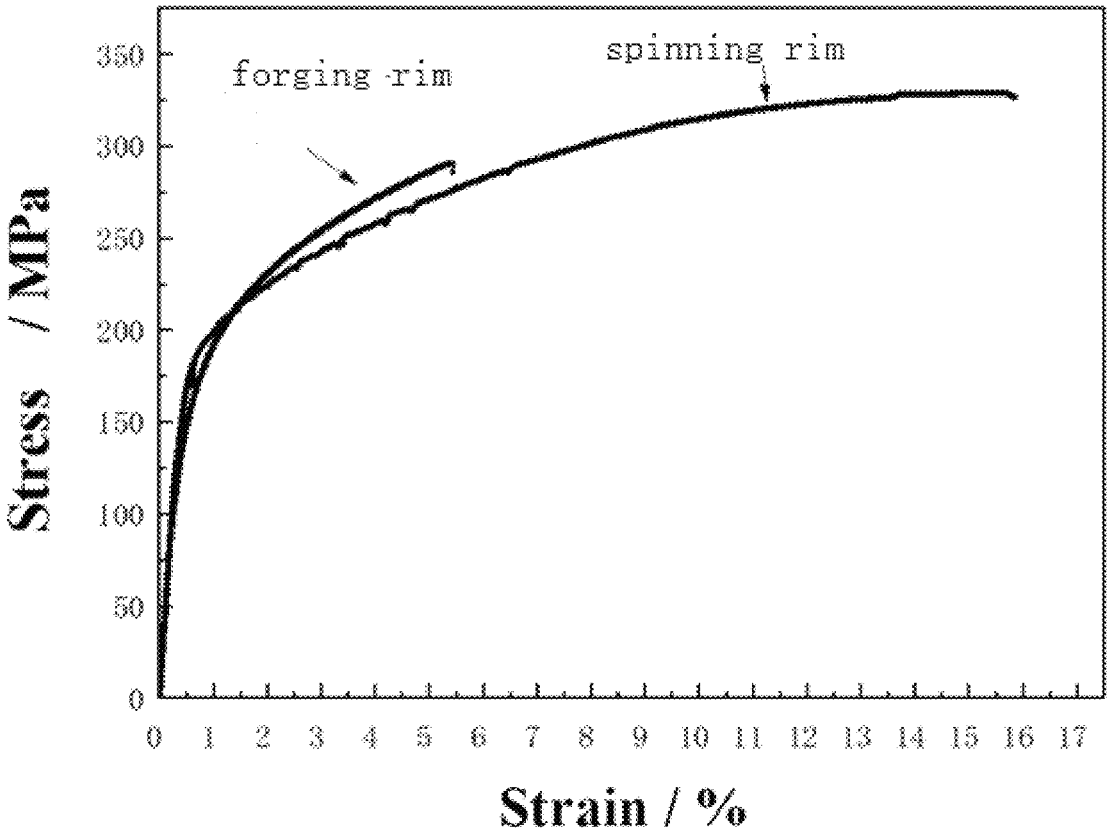
FIG. 7 is a material performance diagram of the wheel rim part of the spinning process of a magnesium alloy wheel hub of the present disclosure.

As shown in FIGS. 5 and 7, the spinning wheel rim part has excellent microstructure and mechanical properties, with yield strength reaching 213 MPa, tensile strength reaching 329 MPa and elongation reaching 16%.

As shown in FIG. 5, it can be observed from the drawing that the microstructure of wheel rim is fine and uniform, showing complete recrystallization structure, with yield strength reaching 184 MPa, tensile strength reaching 291 MPa and elongation reaching 5%.

The traditional forging and extrusion process needs large tonnage forging equipment, which has high processing risk, large metal loss and high cost.

Figure 6:
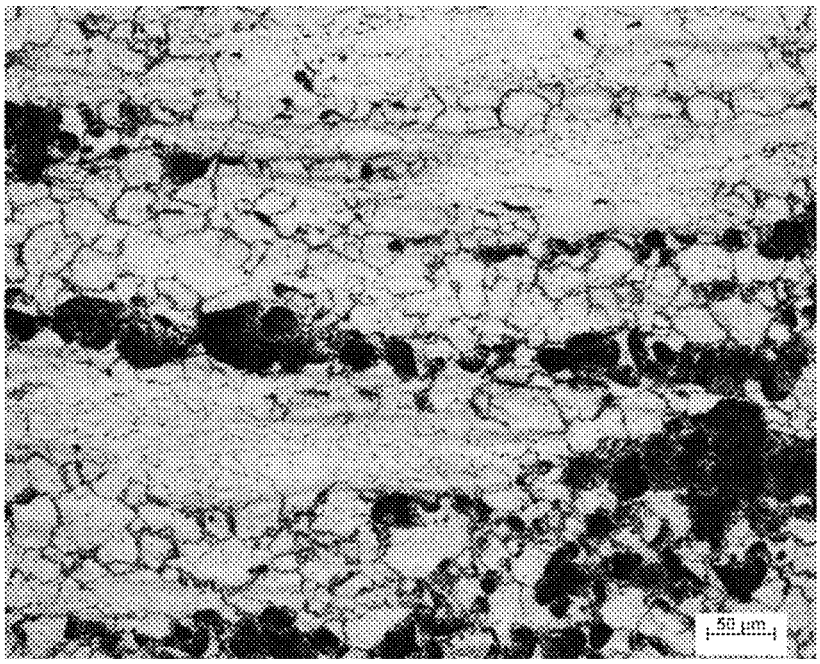
FIG. 6 is a 200-fold metallographic structure of the wheel rim part of a magnesium alloy wheel hub in the conventional forging process of the present disclosure.

As shown in FIGS. 6 and 7, it can be observed from the drawings that the wheel rim of the wheel obtained by the traditional extrusion process has incomplete recrystallization structure with uneven grain size, yield strength reaching 177 MPa, tensile strength reaching 296.5 MPa and elongation reaching 7.3%.

Various performance tests were carried out on the magnesium alloy motor vehicle hub of Example 1. In the test center of CITIC Dicastal Co., Ltd., 13-degree impact strength, radial fatigue, bending fatigue and other wheel strength and fatigue tests were carried out on the above wheels. The test shows that the wheel hub meets the requirements of American wheel SAE J175 and SAE J328-2005, that is, 13-degree impact strength, radial fatigue and bending fatigue performance, and can also meet the requirements of national standards GB/T 5334-2005, GB/T 15704-1995 wheel strength and fatigue performance and industry standard QC/T 991-2015 passenger car light alloy wheel 90-degree impact test method.

A 90-degree impact test was done on the magnesium alloy wheel hubs with traditional forging process and magnesium alloy wheel hubs with new spinning process according to the requirements of industry standard QC/T 991-2015. The results show that the deformation of inner wheel rim of magnesium alloy wheel hub after impact by traditional forging and extrusion process is 12 mm, which indicates the wheel rim strength, and the deformation of inner wheel rim of magnesium alloy wheel hub after impact by new spinning process is 6.7 mm. The impact resistance of magnesium alloy wheel hub produced by new spinning process is stronger. It can be inferred that if the same use requirements are met, the weight reduction space of magnesium alloy wheel hub produced by the new spinning process is larger.

The manufacturing method of the magnesium alloy wheel hub of the disclosure has the following advantages:

In the disclosure, the magnesium alloy bar is heated to a preset temperature, so that the magnesium alloy bar is easier to deform and is not easy to generate forging cracks; the final forged blank is solid dissolved for more than 16 h, and then is spun directly at the solid solution temperature of 400-420° C. Spinning is carried out in three times, the thinning (machining) amount is 25-36%, 14-22%, 6-12% respectively, the total thinning amount reaches 45-70%, the feed speed needs to be controlled at 120-190 mm/min, and the spindle speed is controlled at 280-350 r/min, so that the deformation process of magnesium alloy is more continuous, the spinning process is easier, and the magnesium alloy wheel hub with excellent performance is obtained, which greatly improves the spinning process and machining efficiency.

The magnesium alloy wheel hub obtained by the above method still has excellent mechanical properties, which meets the requirements of American wheel SAE J175 and SAE J328-2005, namely 13-degree impact strength, radial fatigue and bending fatigue performance, and can also meet the requirements of national standards GB/T 5334-2005 and GB/T 15704-1995 for wheel strength and fatigue and industry standard QC/T 991-2015 passenger car light alloy wheel 90-degree impact test method. The following table is the reliability test data table of impact and fatigue.

| Preparation process | 90-degree impact (wheel rim deformation ) | Radial fatigue | Bending fatigue (heavy load) | Bending fatigue (light load) | 13-degree impact |
|---|---|---|---|---|---|
| Traditional forging process | 12 mm | 2.8 million (limit) | 350,000 (limit) | 1.9 million (limit) | Qualified |
| New spinning process | 6.7 mm | 3.6 million (limit) | 500,000 (limit) | 6 million (limit) | Qualified |

The above are only preferred embodiments of the present disclosure and are not intended to limit the present disclosure. Any modifications, equivalents, modifications, etc. made within the spirit and principles of the present disclosure should be included in the scope of protection of the present disclosure.

What is claimed is:

1. A spinning process of a magnesium alloy wheel hub, wherein the spinning process comprises the following steps:

Step 1, heating a magnesium alloy bar at 350-430° C. and keeping the temperature for 20 minutes;

Step 2, initially forging and forming on the bar under a forging press, wherein the forging down-pressing speed is 6-15 mm/s;

Step 3, finally forging and forming on the bar under a forging press to obtain a final forged magnesium alloy blank, wherein the forging down-pressing speed is 5-8 mm/s;

Step 4, stress relief annealing on the final forged magnesium alloy blank, the stress relief annealing temperature is 300-350° C., and the holding time of the stress relief annealing is 6-8 h;

Step 5, solution treatment on the annealed magnesium alloy blank, the solution treatment temperature is 390-420° C., and the holding time of the solution treatment is 16-24 h;

Step 6, taking out the blank after solution treatment and directly spinning by a spinning machine;

Step 7, aging treatment.

2. The spinning process of a magnesium alloy wheel hub according to claim 1, wherein the forging press comprises a 6000-ton forging press.

3. The spinning process of the magnesium alloy wheel hub according to claim 1, wherein the aging treatment temperature in step 7 is 140-170° C. and the aging treatment time is 16-24 h.

4. The spinning process of the magnesium alloy wheel hub according to claim 1, wherein the spinning process in step 6 is carried out in three times, and the spinning thinning amounts are 25-36%, 14-22% and 6-12%, respectively, and the total thinning amount reaches 45-70%.

5. The spinning process of the magnesium alloy wheel hub according to claim 4, wherein the spinning feed speed is 120-190 mm/min and the spindle speed is 280-350 r/min.

6. The spinning process of a magnesium alloy wheel hub according to claim 1, wherein the magnesium alloy comprises an AZ80 magnesium-aluminum-zinc alloy.

7. The spinning process of a magnesium alloy wheel hub according to claim 1, wherein the magnesium alloy comprises a ZK60 magnesium-zinc-zirconium alloy.

8. The spinning process of the magnesium alloy wheel hub according to claim 1, wherein the magnesium alloy wheel hub is manufactured by machining after aging treatment.

* * * * *